US009811012B2

(12) United States Patent
Murakami et al.

(10) Patent No.: US 9,811,012 B2
(45) Date of Patent: Nov. 7, 2017

(54) ELECTROPHOTOGRAPHIC PHOTOSENSITIVE MEMBER, PROCESS CARTRIDGE, ELECTROPHOTOGRAPHIC APPARATUS AND PROCESS FOR PRODUCING ELECTROPHOTOGRAPHIC PHOTOSENSITIVE MEMBER

(71) Applicant: CANON KABUSHIKI KAISHA, Tokyo (JP)

(72) Inventors: Mai Murakami, Kashiwa (JP); Ryoichi Tokimitsu, Kashiwa (JP); Wataru Kitamura, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/265,995

(22) Filed: Sep. 15, 2016

(65) Prior Publication Data

US 2017/0090309 A1 Mar. 30, 2017

(30) Foreign Application Priority Data

Sep. 24, 2015 (JP) ..... 2015-187179
Aug. 31, 2016 (JP) ..... 2016-169483

(51) Int. Cl.
*G03G 5/14* (2006.01)

(52) U.S. Cl.
CPC ..... *G03G 5/144* (2013.01)

(58) Field of Classification Search
CPC ..... G03G 5/144
See application file for complete search history.

(56) References Cited

U.S. PATENT DOCUMENTS

| | | | | |
|---|---|---|---|---|
| 5,876,890 | A | 3/1999 | Kitamura et al. | |
| 5,912,098 | A | 6/1999 | Tanaka et al. | |
| 6,405,005 | B1 | 6/2002 | Kitamura et al. | |
| 6,408,152 | B1 | 6/2002 | Kitamura et al. | |
| 7,645,547 | B2 | 1/2010 | Okuda et al. | |
| 7,655,370 | B2 | 2/2010 | Kitamura et al. | |
| 2014/0004450 | A1 | 1/2014 | Tokimitsu et al. | |
| 2014/0295344 | A1* | 10/2014 | Murakami | G03G 5/0525 430/131 |
| 2015/0346620 | A1 | 12/2015 | Kitamura et al. | |
| 2016/0070184 | A1 | 3/2016 | Nakata et al. | |
| 2016/0327876 | A1 | 11/2016 | Miyauchi et al. | |

FOREIGN PATENT DOCUMENTS

| | | |
|---|---|---|
| JP | 2006-221094 | 8/2006 |
| JP | 2013-137518 | 7/2013 |

* cited by examiner

*Primary Examiner* — Hoa V Le
(74) *Attorney, Agent, or Firm* — Fitzpatrick Cella Harper and Scinto

(57) ABSTRACT

The present invention provides an electrophotographic photosensitive member in which an undercoat layer contains a metal oxide particle, a particular benzophenone compound and a particular ketone compound, a process cartridge and an electrophotographic apparatus each including the electrophotographic photosensitive member and a process for producing the electrophotographic photosensitive member.

9 Claims, No Drawings

ELECTROPHOTOGRAPHIC PHOTOSENSITIVE MEMBER, PROCESS CARTRIDGE, ELECTROPHOTOGRAPHIC APPARATUS AND PROCESS FOR PRODUCING ELECTROPHOTOGRAPHIC PHOTOSENSITIVE MEMBER

BACKGROUND OF THE INVENTION

Field of the Invention

The present invention relates to an electrophotographic photosensitive member, a process cartridge and an electrophotographic apparatus each including an electrophotographic photosensitive member and a process for producing an electrophotographic photosensitive member.

Description of the Related Art

In recent years, an electrophotographic photosensitive member (organic electrophotographic photosensitive member) including a support, an undercoat layer on the support and a photosensitive layer on the undercoat layer has widely been used.

In the undercoat layer, a metal oxide particle and an organic compound are often contained in order to stabilize electrical properties and suppress image defects.

Japanese Patent Application Laid-Open No. 2006-221094 discloses a technology in which a metal oxide particle and an acceptor compound such as an anthraquinone compound are contained in the undercoat layer.

The acceptor compound can have a group that can react particularly with the metal oxide particle. It is described that image defects such as a ghost phenomenon and fogging are suppressed by imparting an acceptor property to the undercoat layer with the acceptor compound contained in the undercoat layer.

Japanese Patent Application Laid-Open No. 2013-137518 discloses a technology that suppresses a ghost phenomenon with a metal oxide particle and a benzophenone compound having a hydroxy group or an amino group each contained in the undercoat layer. It is inferred that an organic compound having such a substituent interacts with the metal oxide particle to make the acceptance and donation of electrons between metal oxide particles in the undercoat layer or from a photosensitive layer to the undercoat layer smooth.

However, in the case where an electrophotographic photosensitive member including an undercoat layer containing a metal oxide particle is placed under a high-temperature and high-humidity environment to absorb moisture, repetitive use of the electrophotographic photosensitive member makes the electrical properties deteriorated in some cases. Although it is anticipated that the constitution of the prior technology enhances the effect of acceptance and donation of electrons of the metal oxide particle, an electrophotographic photosensitive member having further stable electrical properties even under various environments is required in the trend toward higher speed operation and higher image quality in electrophotographic apparatuses in the future.

SUMMARY OF THE INVENTION

The present invention is directed to providing an electrophotographic photosensitive member whose deterioration of the electrical properties when used repeatedly is suppressed even in the case where the electrophotographic photosensitive member is left to stand under a high-temperature and high-humidity environment for some time, and a process cartridge and an electrophotographic apparatus each including the electrophotographic photosensitive member. Further, the present invention is also directed to providing a process for producing the electrophotographic photosensitive member.

According to one aspect of the present invention, there is provided an electrophotographic photosensitive member including: a support; an undercoat layer on the support; and a photosensitive layer on the undercoat layer, in which the undercoat layer contains:

(α) a metal oxide particle;

(β) a compound represented by the following formula (1); and (1)

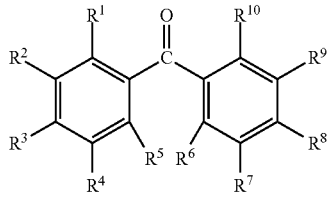

(in the formula (1), $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group. $R^6$ to $R^{10}$ each independently represent a hydroxy group, a halogen atom, an alkyl group having 1 or more and 6 or less carbon atoms, an alkoxy group having 1 or more and 8 or less carbon atoms, or an amino group. However, 1 or 2 of $R^6$ to $R^{10}$ are hydroxy groups and there is not a case where 3 or more of $R^6$ to $R^{10}$ are hydroxy groups.) (γ) a compound represented by the following formula (2).

(2)

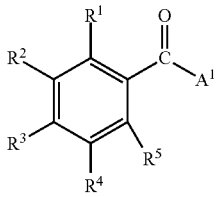

(in the formula (2), $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group. $A^1$ represents an alkenyl group having 2 or more and 4 or less carbon atoms.)

According to another aspect of the present invention, there is provided a process cartridge integrally supporting: the electrophotographic photosensitive member; and at least one unit selected from the group consisting of a charging unit, a developing unit, a transferring unit and a cleaning unit, the process cartridge being detachably attachable to an electrophotographic apparatus main body.

According to further aspect of the present invention, there is provided an electrophotographic apparatus including: the electrophotographic photosensitive member; a charging unit; an exposing unit; a developing unit; and a transferring unit.

According to further aspect of the present invention, there is provided a process for producing an electrophotographic photosensitive member, the process including: forming an undercoat layer on a support; and forming a photosensitive layer on the undercoat layer, in which forming the undercoat layer is coating the support with a coating liquid for an undercoat layer to form a coating film, the coating liquid containing:

(α) a metal oxide particle;

(β) a compound represented by the formula (1); and (γ) a compound represented by the formula (2), and drying and/or curing the coating film, thereby forming the undercoat layer.

According to the present invention, an electrophotographic photosensitive member whose deterioration of the electrical properties when used repeatedly is suppressed even in the case where the electrophotographic photosensitive member is left to stand under a high-temperature and high-humidity environment for some time, and a process cartridge and an electrophotographic apparatus each including the electrophotographic photosensitive member can be provided. Moreover, according to the present invention, a process for producing the electrophotographic photosensitive member can be provided.

Further features of the present invention will become apparent from the following description of exemplary embodiments.

DESCRIPTION OF THE EMBODIMENTS

Preferred embodiments of the present invention will now be described in detail.

In an electrophotographic photosensitive member according to the present invention, an undercoat layer contains the following (α), (β) and (γ).

(α) is a metal oxide particle.

Examples of the metal oxide particle include a particle of a metal oxide such as titanium oxide, zinc oxide, tin oxide, zirconium oxide and aluminum oxide.

The metal oxide particle can be a particle having a number average particle diameter of primary particles of 0.1 μm or less from the standpoint of dispersibility in a coating liquid for an undercoat layer and of the electrical properties of the electrophotographic photosensitive member.

Moreover, the metal oxide particle can be subjected to surface treatment. Among surface-treated metal oxide particles, a surface treated zinc oxide particle is preferable from the standpoint of the electrical properties of the electrophotographic photosensitive member.

In the present invention, one kind of metal oxide particle as (α) may be used alone, or 2 or more metal oxide particles, such as metal oxide particles of different kinds of metal oxides and metal oxide particles each being different in terms of whether subjected to surface treatment or not, each being subjected to a different kind of surface treatment, or each having a different specific surface area, can be used together.

(β) is a compound represented by the following formula (1).

(1)

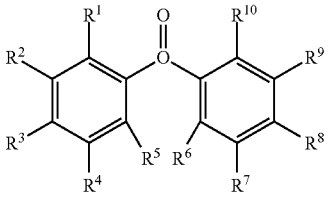

In the formula (1), $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group. $R^6$ to $R^{10}$ each independently represent a hydrogen atom, a hydroxy group, a halogen atom, an alkyl group having 1 or more and 6 or less carbon atoms, an alkoxy group having 1 or more and 8 or less carbon atoms, or an amino group. However, 1 or 2 of $R^6$ to $R^{10}$ are hydroxy groups and there is not a case where 3 or more of $R^6$ to $R^{10}$ are hydroxy groups.

The electrical properties of the electrophotographic photosensitive member can be stabilized and images having few image defects can be output by the compound represented by the formula (1) being contained in the undercoat layer together with the metal oxide particle.

Specific examples of the compound represented by the formula (1) are shown below, but the present invention is not limited by the examples.

(1-1)

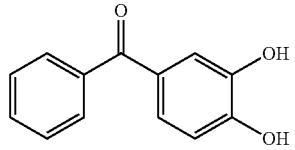

(1-2)

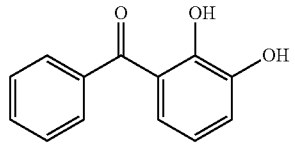

(1-3)

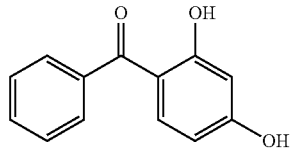

(1-4)

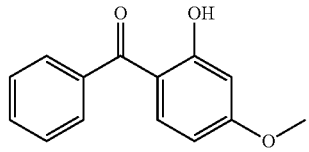

(1-5)

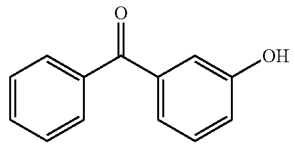

(1-6)

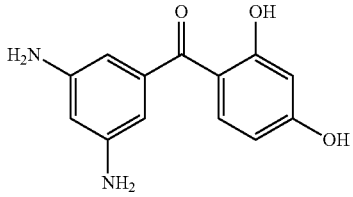

-continued (1-7)

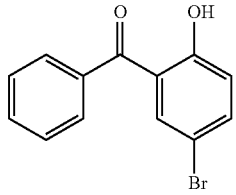

(1-8)

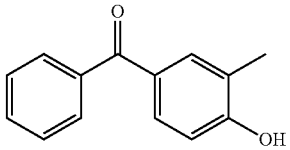

(1-9)

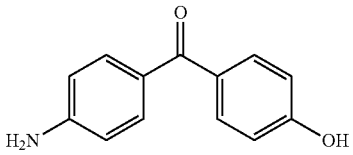

(1-10)

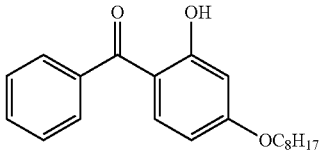

(1-11)

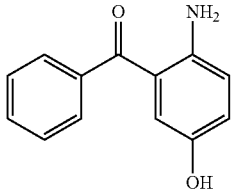

(1-12)

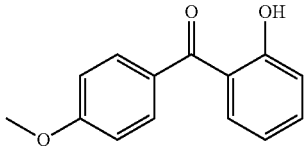

(1-13)

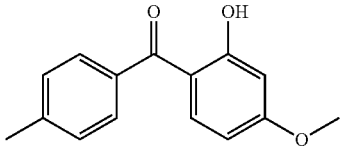

(1-14)

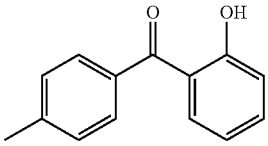

Among the compounds, the compound represented by the formula (1-1) and the compound represented by the formula (1-2) each being a compound in which adjacent 2 groups of $R^6$ to $R^{10}$ in the formula (1) are hydroxy groups are preferable from the standpoint of the interaction with the metal oxide particle.

The content of the compound represented by the formula (1) in the coating liquid for an undercoat layer can be 0.1% by mass or more and 4.0% by mass or less relative to the metal oxide particle in the coating liquid for an undercoat layer. When the content of the compound represented by the formula (1) is 0.1% by mass or more, the interaction with the metal oxide particle is more enhanced. When the content of the compound represented by the formula (1) is 4.0% by mass or less, the stability of the coating liquid for an undercoat layer is hard to lower.

(γ) is a compound represented by the formula (2).

(2)

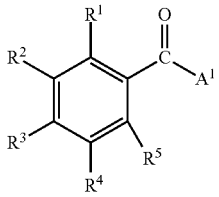

In the formula (2), $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group. $A^1$ represents an alkenyl group having 2 or more and 4 or less carbon atoms.

The electrical properties of the electrophotographic photosensitive member are stabilized by the compound represented by the formula (2) as (γ) being contained in the undercoat layer together with the metal oxide particle as (α) and the compound represented by the formula (1) as (β) even in the case where the electrophotographic photosensitive member absorbs moisture under a high-temperature and high-humidity environment. With respect to the reason for the effect, the present inventors infer that the compound represented by the formula (2) as (γ) enhances the coordination of (β) to the metal oxide particle. For example, the compound represented by the formula (2) captures a substance that inhibits the coordination of the compound represented by the formula (1) to the metal oxide particle, thereby making the coordination of the compound represented by the formula (1) to the metal oxide particle easy. It is inferred that, as a result, the electrical properties of the electrophotographic photosensitive member are stabilized even in the case where the electrophotographic photosensitive member absorbs moisture.

Specific examples of the compound represented by the formula (2) are shown below, but the present invention is not limited by the examples.

(2-1)

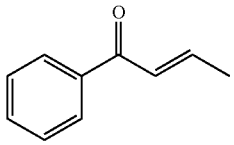

(2-2)

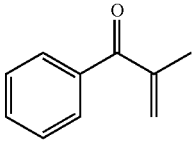

-continued (2-3)

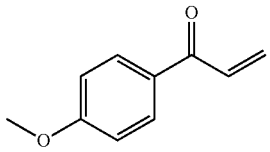

(2-4)

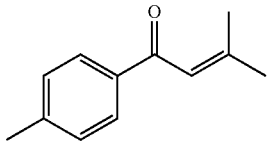

(2-5)

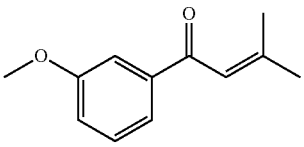

(2-6)

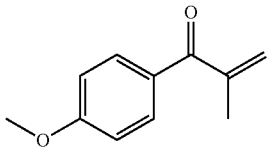

Among the above compounds, the compound represented by the formula (2-1) in which $A^1$ in the formula (2) is a 1-propenyl group is preferable.

The content of the compound represented by the formula (2) in the coating liquid for an undercoat layer can be 1.0% by mass or more and 15% by mass or less relative to the compound represented by the formula (1) in the coating liquid for an undercoat layer. When the content of the compound represented by the formula (2) is 1.0% by mass or more, the effect is sufficiently obtained. When the content of the compound represented by the formula (2) is 15% by mass or less, the stability of the coating liquid for an undercoat layer is hard to lower.

It can be confirmed by head space gas chromatography/mass analysis or the like that the undercoat layer contains the compound represented by the formula (2).

The coating liquid for an undercoat layer can contain 10% by mass or more and 50% by mass or less of a binder resin (organic resin) for an undercoat layer relative to the metal oxide particle.

Examples of the binder resin for an undercoat layer include acrylic resins, allyl resins, alkyd resins, ethyl cellulose resins, ethylene-acrylic copolymers, epoxy resins, casein resins, silicone resins, gelatin resins, phenol resins, butyral resins, polyacrylates, polyacetals, polyamide-imides, polyamides, polyallyl ethers, polyimides, polyurethanes, polyesters, polyethylenes, polycarbonates, polystyrenes, polysulfones, polyvinyl alcohols, polybutadienes and polypropylenes. Among the binder resins, polyurethanes are preferable.

These resins can be used alone or in combination of two or more as a single polymer, a mixed polymer or a copolymer.

The coating liquid for an undercoat layer can be prepared by subjecting (α), (β), (γ), the binder resin (organic resin) and a solvent to dispersion treatment. Moreover, the coating liquid for an undercoat layer can also be prepared by subjecting (α), (β) and (γ) to dispersion treatment, then adding thereto a liquid containing the binder resin (organic resin) dissolved therein, and further subjecting the resultant mixture to dispersion treatment.

Examples of the solvent for use in the coating liquid for an undercoat layer include organic solvents such as alcohol-based, ketone-based, ether-based, ester-based, halogenated hydrocarbon-based and aromatic-based organic solvents.

Examples of the dispersion treatment method include methods using a homogenizer, a paint shaker, an ultrasonic disperser, a ball mill, a sand mill, a roll mill, a vibrating mill, an attritor and a liquid collision type high speed disperser.

The coating liquid for an undercoat layer may contain a fine particle of an organic resin or a levelling agent as necessary for the purpose of adjusting the surface roughness or transmittance of the undercoat layer, reduction of cracks in the undercoat layer, or other purposes. Examples of the organic resin particle include hydrophobic organic resin particles such as a silicone particle and hydrophilic organic resin particles such as a crosslink type polymethacrylate resin (PMMA) particle.

Examples of the coating method with the coating liquid for an undercoat layer include a dip coating method, a spray coating method, a spinner coating method, a bead coating method, a Meyer bar coating method, a blade coating method and a beam coating method.

Examples of the method of drying the coating film of the coating liquid for an undercoat layer include drying by heating and fan drying.

The film thickness of the undercoat layer is preferably 0.5 μm or more and 30 μm or less, more preferably 1 μm or more and 25 μm or less.

As described above, the electrophotographic photosensitive member according to the present invention includes a support, an undercoat layer on the support, and a photosensitive layer on the undercoat layer.

The photosensitive layer may be a single layer type photosensitive layer that contains a charge generating substance and a charge transporting substance in a single layer or may be a function separation type (lamination type) photosensitive layer that separate functions into a charge transporting layer that contains the charge transporting substance and a charge generating layer that contains the charge generating substance. The function separation type (lamination type) photosensitive layer is preferable and the function separation type (lamination type) photosensitive layer obtained by laminating the charge generating layer and the charge transporting layer in this order from the support side is more preferable from the standpoint of electrophotographic properties. Moreover, a protective layer may also be provided on the photosensitive layer as necessary.

The support can be a support having electrical conductivity (electrically conductive support).

As the support (electrically conductive support), a support made of a metal (alloy) such as aluminum, aluminum alloy, stainless steel, or nickel can be used. Moreover, a support made of a metal (alloy) or a support made of a plastic, the support having a layer formed through vacuum deposition of aluminum, aluminum alloy, indium oxide-tin oxide alloy or the like can also be used. Moreover, a support obtained by impregnating a plastic or paper with carbon black, a tin oxide particle, a titanium oxide particle or a silver particle, or a support made of a plastic and having an electrically conductive resin can also be used.

Examples of the shape of the support include a cylindrical shape and a belt shape. Of these shapes, the cylindrical shape is preferable.

The surface of the support may be subjected to cutting treatment, roughening treatment, alumite treatment or the like for the purpose of suppressing interference fringes due to laser light scattering.

An electrically conductive layer may be provided between the support and the undercoat layer for the purpose of suppressing interference fringes due to laser light scattering or coating the scratches on the support.

The electrically conductive layer can be formed by dispersing an electrically conductive particle such as carbon black or a metal oxide particle in the binder resin.

The film thickness of the electrically conductive layer is preferably 5 μm or more and 40 μm or less, more preferably 10 μm or more and 30 μm or less.

The undercoat layer according to the present invention is provided between the support or the electrically conductive layer and the photosensitive layer (charge generating layer, charge transporting layer).

Examples of the charge generating substance for use in the photosensitive layer include azo pigments such as monoazo pigments, disazo pigments and trisazo pigments, phthalocyanine pigments such as metal phthalocyanines and non-metal phthalocyanines, indigo pigments such as indigo and thioindigo, perylene pigments such as perylene acid anhydrides and perylene acid imides, polycyclic quinone pigments such as anthraquinone, pyrene quinone and dibenzopyrene quinone, squarylium dyes, pyrylium salts and thiapyrylium salts, triphenylmethane dyes, quinacridone pigments, azulenium salt pigments, cyanine pigments such as quinocyanines, anthanthrone pigments, pyranthrone pigments, xanthene dyes, quinoneimine dyes and styryl dyes.

Among the charge generating substances, phthalocyanine pigments and azo pigments are preferable, and among the phthalocyanine pigments and azo pigments, phthalocyanine pigments are more preferable from the standpoint of sensitivity. Moreover, among the phthalocyanine pigments, oxytitanium phthalocyanine, chloro gallium phthalocyanine and hydroxy gallium phthalocyanine are preferable.

These charge generating substances may be used alone or in combination of two or more.

In the case where the photosensitive layer is a lamination type, examples of the binder resin for a charge generating layer include acrylic resins, allyl resins, alkyd resins, epoxy resins, diallyl phthalate resins, styrene-butadiene copolymers, butyral resins, benzal resins, polyacrylates, polyacetals, polyamide-imides, polyamides, polyallyl ethers, polyarylates, polyimides, polyurethanes, polyesters, polyethylenes, polycarbonates, polystyrenes, polysulfones, polyvinyl acetals, polybutadienes, polypropylenes, methacrylic resins, urea resins, vinyl chloride-vinyl acetate copolymers, vinyl acetate resins and vinyl chloride resins. Among these binder resins, butyral resins are particularly preferable.

These resins can be used alone or in combination of two or more as a single polymer, a mixed polymer, or a copolymer.

The charge generating layer can be formed in such a way that a coating film is formed through coating with a coating liquid for a charge generating layer, which is obtained by subjecting the charge generating substance to dispersion treatment together with the binder resin and the solvent, and then the coating film is dried.

Examples of the dispersion treatment method include methods using a homogenizer, a paint shaker, an ultrasonic disperser, a ball mill, a sand mill, a roll mill, a vibrating mill, an attritor and a liquid collision type high speed disperser.

The ratio of the charge generating substance to the binder resin (charge generating substance: binder resin) in the charge generating layer can be within a range of 0.3:1 to 10:1 based on the mass ratio.

The solvent for use in the coating liquid for a charge generating layer can be selected in consideration of the solubility and dispersion stability of the binder resins and charge generating substance for use in the charge generating layer. Examples of the solvent include organic solvents such as alcohols, sulfoxides, ketones, ethers, esters, halogenated aliphatic hydrocarbons and aromatic compounds.

The film thickness of the charge generating layer is preferably 5 μm or less, more preferably 0.1 μm or more and 2 μm or less.

The charge generating layer can contain various kinds of sensitizers, antioxidants, ultraviolet absorbers and plasticizers as necessary.

Examples of the charge transporting substance for use in the photosensitive layer include triarylamine compounds, hydrazone compounds, styryl compounds, stilbene compounds and butadiene compounds.

Among these charge transporting substances, triarylamine compounds are preferable from the standpoint of charge mobility.

In the case where the photosensitive layer is a lamination type, examples of the binder resin for a charge transporting layer include acrylic resins, acrylonitrile resins, allyl resins, alkyd resins, epoxy resins, silicone resins, phenol resins, phenoxy resins, polyacrylamides, polyamide-imides, polyamides, polyallyl ethers, polyarylates, polyimides, polyurethanes, polyesters, polyethylenes, polycarbonates, polysulfones, polyphenylene oxides, polybutadienes, polypropylenes and methacrylic resins. Among these binder resins, polyarylates and polycarbonates are particularly preferable.

These resins can be used alone or in combination of two or more as a single polymer, a mixed polymer, or a copolymer.

The charge transporting layer can be formed in such a way that a coating film is formed through coating with a coating liquid for a charge transporting layer, which is obtained by dissolving the charge transporting substance and the binder resin in the solvent, and then the coating film is dried.

The ratio of the charge transporting substance to the binder resin (charge transporting substance: binder resin) in the charge transporting layer can be within a range of 0.3:1 to 10:1 based on the mass ratio. Moreover, the temperature for drying the coating film is preferably 60° C. or higher and 150° C. or lower, more preferably 80° C. or higher and 120° C. or lower from the standpoint of suppression of cracks. Moreover, the time for drying the coating film can be 10 minutes or more and 60 minutes or less.

Examples of the solvent for use in the coating liquid for a charge transporting layer include alcohols (particularly, alcohols having 3 or more carbon atoms) such as propanol and butanol, aromatic hydrocarbons such as anisole, toluene, xylene and chlorobenzene and alkylcycloalkanes such as methylcyclohexane and ethylcyclohexane.

Moreover, in the case where the charge transporting layer is made to be a lamination configuration, the charge transporting layer on the surface side of the electrophotographic photosensitive member can be a layer as follows.

That is to say, the charge transporting layer can be a layer cured by polymerizing and/or crosslinking the charge transporting substance having a chain-polymerizable functional group in order to enhance the mechanical strength of the electrophotographic photosensitive member.

Examples of the chain-polymerizable functional group include an acryloyloxy group, an alkoxysilyl group and an epoxy group.

In order to polymerize and/or crosslink the charge transporting substance having a chain-polymerizable functional group, heat, light, or radioactive rays (such as electron beams) can be used.

In the case where the charge transporting layer of the electrophotographic photosensitive member is a single layer, the film thickness of the charge transporting layer is preferably 5 μm or more and 40 μm or less, more preferably 8 μm or more and 30 μm or less.

In the case where the charge transporting layer is made to be a two-layered lamination configuration, the film thickness of the charge transporting layer on the support side of the electrophotographic photosensitive member can be 5 μm or more and 30 μm or less, and the film thickness of the charge transporting layer on the surface side of the electrophotographic photosensitive member can be 1 μm or more and 10 μm or less.

The charge transporting layer can contain various kinds of antioxidants, ultraviolet absorbers and plasticizers as necessary.

A protective layer may be provided on the photosensitive layer for the purpose of protecting the photosensitive layer.

The protective layer can be formed in such a way that a coating film is formed through coating with a coating liquid for a protective layer, which is obtained by dissolving various kinds of binder resins in the solvent, and then the coating film is dried.

Moreover, the protective layer may also be formed in such a way that a coating film is formed through coating with a coating liquid for a protective layer, which is obtained by dissolving a resin monomer or an oligomer in the solvent, and then the coating film is cured and/or dried.

In order to cure the coating film, light, heat, or radioactive rays (such as electron beams) can be used.

The film thickness of the protective layer is preferably 0.5 μm or more and 10 μm or less, more preferably 1 μm or more and 7 μm or less.

The protective layer can contain an electrically conductive particle or the like as necessary.

Examples of the coating method with the coating liquid for each layer include a dip coating method, a spray coating method, a spinner coating method, a bead coating method, a roller coating method, a Meyer bar coating method, a blade coating method and a beam coating method.

The outermost surface layer (surface layer) of the electrophotographic photosensitive member may contain a lubricant such as a silicone oil, wax, a polytetrafluoroethylene particle, a silica particle, an aluminum particle or boron nitride.

The process cartridge according to the present invention integrally supports the electrophotographic photosensitive member according to the present invention and at least one unit selected from the group consisting of a charging unit, a developing unit, a transferring unit and a cleaning unit and is detachably attachable to an electrophotographic apparatus main body.

Moreover, the electrophotographic apparatus according to the present invention includes the electrophotographic photosensitive member according to the present invention, a charging unit, an exposing unit, a developing unit and a transferring unit.

Hereinafter, the present invention will be described in more detail giving specific examples. However, the present invention is not limited to these examples. It is to be noted that "parts" in Examples mean "parts by mass" and "%" means "% by mass".

Example 1

Surface Treatment of Metal Oxide

With 500 parts of toluene, 100 parts of a zinc oxide particle (specific surface area: 19 $m^2/g$, powder resistance: $4.7\times10^6$ Ω·cm) was stirred and mixed. Then, 0.8 parts of a silane coupling agent (compound name: N-2-(aminoethyl)-3-aminopropyl methyl dimethoxy silane, trade name: KBM602, manufactured by Shin-Etsu Chemical Co., Ltd.) was added thereto and the resultant mixture was stirred for 6 hours. Thereafter, toluene was distilled away under reduced pressure and the residue was dried by heating at 130° C. for 6 hours to obtain a surface-treated zinc oxide particle.

(Production of Electrophotographic Photosensitive Member)

An aluminum cylinder having a diameter of 30 mm and a length of 357.5 mm was used as a support (electrically conductive support).

With a mixed solvent of 72 parts of methyl ethyl ketone and 72 parts of 1-butanol, 80 parts of the surface-treated zinc oxide particle, 0.8 parts of the compound represented by the formula (1-1), 1.6 parts of a methyl ethyl ketone solution containing 1% of the compound represented by the formula (2-1), 15 parts of a blocked isocyanate (trade name: Sumidur 3175, manufactured by Sumitomo Bayer Urethane Co., Ltd.) as a curing agent and 15 parts of a polyvinyl butyral resin (trade name: S-LEC BM-1, manufactured by Sekisui Chemical Co., Ltd.) as a polyol resin were mixed. The resultant mixture was placed in a sand mill apparatus with a glass bead having a diameter of 0.8 mm and was subjected to dispersion treatment under an atmosphere of 23±3° C. for 3 hours. After the dispersion treatment, 0.01 parts of a silicone oil (trade name: SH 28 PA, manufactured by Dow Corning Toray Co., Ltd.) and 5.6 parts of a crosslinked polymethylmethacrylate (PMMA) particle (trade name: Techpolymer SSX-103, manufactured by Sekisui Plastics Co., Ltd.) were added thereto and the resultant mixture was stirred to prepare a coating liquid for an undercoat layer.

The support was coated with the coating liquid for an undercoat layer to form a coating film and the coating film was dried at 160° C. for 40 minutes to form an undercoat layer having a film thickness of 18 μm.

Subsequently, 4 parts of a hydroxy gallium phthalocyanine crystal (charge generating substance) of a crystal form having intense peaks at a Bragg angle 2θ±0.20 of 7.4° and of 28.10 in CuKα characteristic X-ray diffraction and 0.04 parts of a compound represented by the following formula (A)

(A)

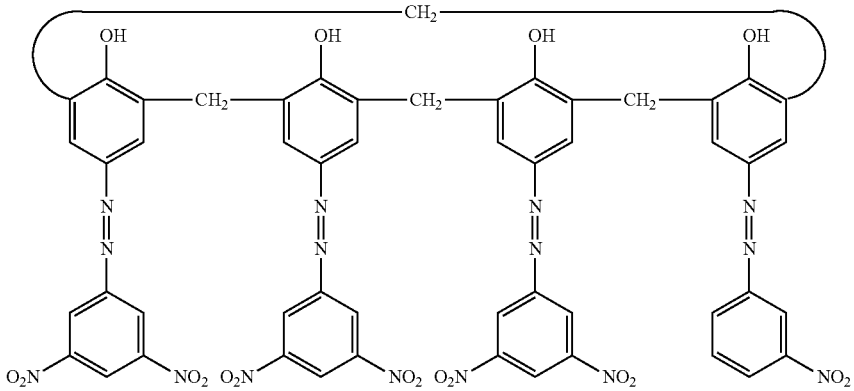

were added to a liquid obtained by dissolving 2 parts of polyvinyl butyral (trade name: S-LEC BX-1, manufactured by Sekisui Chemical Co., Ltd.) in 100 parts of cyclohexanone. Thereafter, the resultant mixture was placed in a sand mill with a glass bead having a diameter of 1 mm and was subjected to dispersion treatment under an atmosphere of 23±3° C. for 1 hour. After the dispersion treatment, 100 parts of ethyl acetate was added thereto to prepare a coating liquid for a charge generating layer.

The undercoat layer was dip-coated with the coating liquid for a charge generating layer to form a coating film and the coating film was dried at 90° C. for 10 minutes to form a charge generating layer having a film thickness of 0.19 μm.

Subsequently, 60 parts of the compound represented by the following formula (B) (charge transporting substance), 30 parts of the compound represented by the following formula (C) (charge transporting substance), 10 parts of the compound represented by the following formula (D), (B)

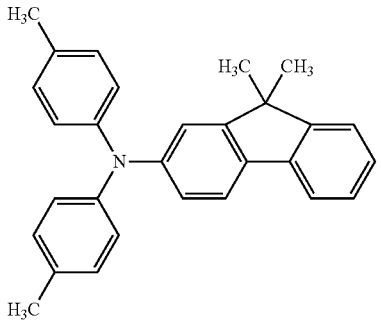

(C)

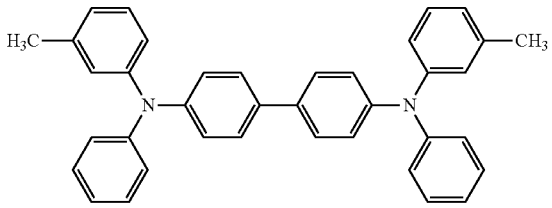

-continued (D)

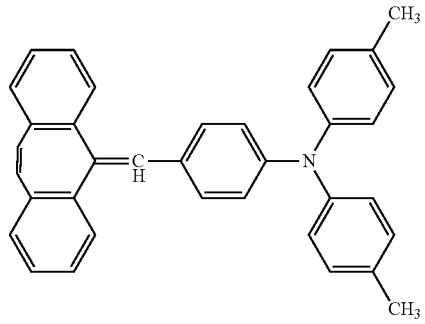

100 parts of a polycarbonate resin (bisphenol Z type polycarbonate, trade name: Iupilon Z400, manufactured by Mitsubishi Engineering-Plastics Corporation) and 0.02 parts of a polycarbonate having a structural unit represented by the following formula (E) (viscosity average molecular weight Mv: 20000)

(E)

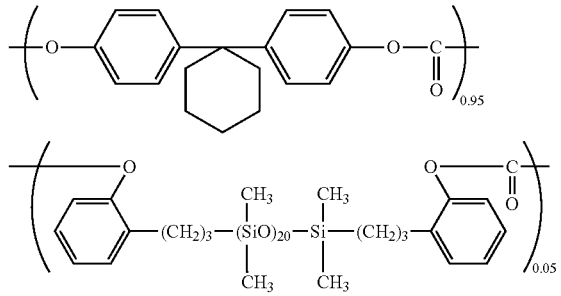

were dissolved in a mixed solvent of 600 parts of chlorobenzene and 200 parts of dimethoxy methane to prepare a coating liquid for a charge transporting layer.

The charge generating layer was dip-coated with the coating liquid for a charge transporting layer to form a coating film and the coating film was dried at 100° C. for 30 minutes to form a charge transporting layer having a film thickness of 21 μm.

Subsequently, 1.5 parts of a fluorine atom-containing resin (trade name: GF-300, manufactured by Toagosei Co., Ltd) was dissolved in a mixed solvent of 45 parts of 1,1,2,2,3,3,4-heptafluorocyclopentane (trade name: ZEORORA H, manufactured by Zeon Corporation) and 45 parts of 1-propanol. Thereafter, a liquid obtained by adding to the resultant mixture 30 parts of a polytetrafluoroethylene particle (trade name: Lubron L-2, manufactured by Daikin Industries, Ltd.) was passed through a high-pressure disperser (trade name: Microfluidizer M-110EH, manufactured by Microfluidizics Corp.) to obtain a dispersion liquid. Thereafter, to the dispersion liquid, 70 parts of the compound represented by the following formula (F) (positive hole transporting compound), (F)

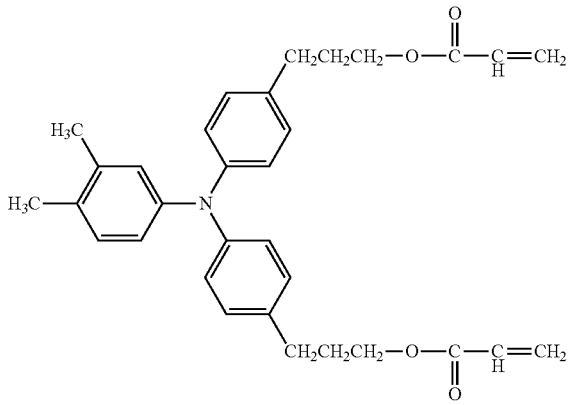

30 parts of 1,1,2,2,3,3,4-heptafluorocyclopentane and 30 parts of 1-propanol were added, and the resultant mixture was filtered with a polyflon filter (trade name: PF-040, manufactured by Advantec Toyo Kaisha, Ltd.) to prepare a coating liquid for a protective layer.

The charge transporting layer was dip-coated with the coating liquid for a protective layer to form a coating film and the coating film was dried at 50° C. for 5 minutes. After drying, the coating film was irradiated with an electron beam under the conditions of an acceleration voltage of 60 kV and an absorbed dose of 8000 Gy for 1.6 seconds in a nitrogen atmosphere. Thereafter, the coating film was subjected to heat treatment for 1 minute in a nitrogen atmosphere under the condition that the temperature of the coating film reached 130° C. In addition, the oxygen concentration from the irradiation with the electron beam to the heat treatment for 1 minute was 20 ppm. Subsequently, the coating film was subjected to heat treatment for 1 hour under the condition that the coating film reached 110° C. to form a protective layer (second charge transporting layer) having a film thickness of 5 μm.

In this way, an electrophotographic photosensitive member including the undercoat layer, the charge generating layer, the charge transporting layer and the protective layer on the support was produced.

Example 2

An electrophotographic photosensitive member was produced in the same manner as in Example 1 except that the amount of the compound used in Example 1 and represented by the formula (1-1) was changed to 0.04 parts and the amount of the methyl ethyl ketone solution used in Example 1 and containing 1% of the compound represented by the formula (2-1) was changed to 0.08 parts.

Example 3

An electrophotographic photosensitive member was produced in the same manner as in Example 1 except that the amount of the compound used in Example 1 and represented by the formula (1-1) was changed to 0.16 parts and the amount of the methyl ethyl ketone solution used in Example 1 and containing 1% of the compound represented by the formula (2-1) was changed to 0.32 parts.

Example 4

An electrophotographic photosensitive member was produced in the same manner as in Example 1 except that the amount of the compound used in Example 1 and represented by the formula (1-1) was changed to 2.4 parts and the amount of the methyl ethyl ketone solution used in Example 1 and containing 1% of the compound represented by the formula (2-1) was changed to 4.8 parts.

Example 5

An electrophotographic photosensitive member was produced in the same manner as in Example 1 except that the amount of the compound used in Example 1 and represented by the formula (1-1) was changed to 4.0 parts and the amount of the methyl ethyl ketone solution used in Example 1 and containing 1% of the compound represented by the formula (2-1) was changed to 8.0 parts.

Example 6

An electrophotographic photosensitive member was produced in the same manner as in Example 1 except that the amount of the methyl ethyl ketone solution used in Example 1 and containing 1% of the compound represented by the formula (2-1) was changed to 0.64 parts.

Example 7

An electrophotographic photosensitive member was produced in the same manner as in Example 1 except that the amount of the methyl ethyl ketone solution used in Example 1 and containing 1% of the compound represented by the formula (2-1) was changed to 8.0 parts.

Example 8

An electrophotographic photosensitive member was produced in the same manner as in Example 1 except that the amount of the methyl ethyl ketone solution used in Example 1 and containing 1% of the compound represented by the formula (2-1) was changed to 16.0 parts.

Example 9

An electrophotographic photosensitive member was produced in the same manner as in Example 1 except that the amount of the compound used in Example 1 and represented by the formula (1-1) was changed to 0.04 parts and the amount of the methyl ethyl ketone solution used in Example 1 and containing 1% of the compound represented by the formula (2-1) was changed to 0.032 parts.

Example 10

An electrophotographic photosensitive member was produced in the same manner as in Example 1 except that 0.8 parts of the compound represented by the formula (1-1) in Example 1 was changed to 0.16 parts of the compound represented by the formula (1-3) and the amount of the methyl ethyl ketone solution used in Example 1 and containing 1% of the compound represented by the formula (2-1) was changed to 0.64 parts.

Example 11

An electrophotographic photosensitive member was produced in the same manner as in Example 10 except that the amount of the compound used in Example 10 and represented by the formula (1-3) was changed to 1.6 parts and the amount of the methyl ethyl ketone solution used in Example 10 and containing 1% of the compound represented by the formula (2-1) was changed to 6.4 parts.

Example 12

An electrophotographic photosensitive member was produced in the same manner as in Example 1 except that 0.8 parts of the compound represented by the formula (1-1) in Example 1 was changed to 1.6 parts of the compound represented by the formula (1-4) and the amount of the methyl ethyl ketone solution used in Example 1 and containing 1% of the compound represented by the formula (2-1) was changed to 6.4 parts.

Example 13

An electrophotographic photosensitive member was produced in the same manner as in Example 1 except that 1.6 parts of the methyl ethyl ketone solution containing 1% of the compound represented by the formula (2-1) in Example 1 was changed to 3.2 parts of a methyl ethyl ketone solution containing 1% of the compound represented by the formula (2-2).

Example 14

An electrophotographic photosensitive member was produced in the same manner as in Example 13 except that the amount of the compound used in Example 13 and represented by the formula (1-1) was changed to 0.04 parts and the amount of the methyl ethyl ketone solution used in Example 13 and containing 1% of the compound represented by the formula (2-2) was changed to 0.032 parts.

Example 15

An electrophotographic photosensitive member was produced in the same manner as in Example 1 except that the compound represented by the formula (1-1) in Example 1 was changed to the compound represented by the formula (1-12) and the compound represented by the formula (2-1) in Example 1 was changed to the compound represented by the formula (2-3).

Example 16

An electrophotographic photosensitive member was produced in the same manner as in Example 15 except that the amount of the methyl ethyl ketone solution used in Example 15 and containing 1% of the compound represented by the formula (2-3) was changed to 8.0 parts.

Example 17

An electrophotographic photosensitive member was produced in the same manner as in Example 15 except that the amount of the compound used in Example 15 and represented by the formula (1-12) was changed to 0.04 parts and the amount of the methyl ethyl ketone solution used in Example 15 and containing 1% of the compound represented by the formula (2-3) was changed to 0.032 parts.

Comparative Example 1

An electrophotographic photosensitive member was produced in the same manner as in Example 1 except that the methyl ethyl ketone solution containing 1% of the compound represented by the formula (2-1) in Example 1 was not used.

Comparative Example 2

An electrophotographic photosensitive member was produced in the same manner as in Example 1 except that the compound represented by the formula (1-1) in Example 1 was not used.

Comparative Example 3

An electrophotographic photosensitive member was produced in the same manner as in Example 1 except that the compound represented by the formula (2-1) in Example 1 was changed to a compound represented by the following formula (G).

(G)

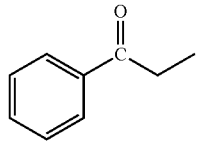

Comparative Example 4

An electrophotographic photosensitive member was produced in the same manner as in Example 1 except that the compound represented by the formula (1-1) in Example 1 was changed to a compound represented by the following formula (H).

(H)

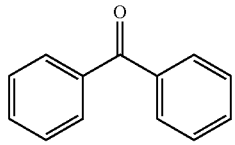

[Evaluation of Electrical Property for Electrophotographic Photosensitive Members]

A modified machine of a copying machine (trade name: imageRUNNER iR-ADV C5051) manufactured by Canon Inc. was used as an evaluation apparatus (electrophotographic apparatus for evaluation). The evaluation apparatus was set under an environment of a temperature of 23° C. and a humidity of 50% RH. Measurement of the surface potential of the electrophotographic photosensitive members was conducted in such a way that a developing cartridge was taken out from the evaluation apparatus and a potential measuring apparatus was inserted into the developing cartridge. The potential measuring apparatus was configured by disposing a potential measuring probe at a developing position of the developing cartridge, and the position of the potential measuring probe was determined to be the center in the bus line direction of the electrophotographic photosensitive member.

Each electrophotographic photosensitive member used for the measurement and produced in Examples 1 to 17 and Comparative Examples 1 to 4 was left to stand under an environment of a temperature of 50° C. and a humidity of 95% RH for 3 days and further under an environment of a temperature of 23° C. and a humidity of 50% RH overnight and thereafter was set in the evaluation apparatus.

As a charging condition, the applied voltage was adjusted so that the initial dark part potential might be −800 V. As an exposing condition, the amount of laser light was adjusted so that the initial bright part potential (VLa) in exposing irradiation with 780 nm laser might be −200 V.

The developing cartridge was attached to the evaluation apparatus and repetitive use of continuous 20000-page image output was carried out for the electrographic photosensitive member. The developing cartridge was left to stand for 5 minutes after 20000-page image output and then attached to the potential measuring apparatus, and the bright part potential (VLb) after the repetitive use was measured for each electrophotographic photosensitive member. In addition, the measurement of the potential was conducted for each electrophotographic photosensitive member under the same charging condition and exposing condition as initially set. The difference between the bright part potential after the repetitive use and the initial bright part potential was determined for each electrophotographic photosensitive member as the amount of variation in bright part potential ($\Delta VL=|VLb|-|VLa|$). The evaluation results are shown in Table 1.

As shown in Table 1, in the electrophotographic photosensitive members of Examples according to the present invention, the deterioration of the electrical property in the repetitive use after the electrophotographic photosensitive members are left to stand for some time under a high-temperature and high-humidity environment is suppressed when compared with the deterioration of the electrical property of the electrophotographic photosensitive members of Comparative Examples not containing (β) or (γ).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-187179, filed Sep. 24, 2015, and Japanese Patent Application No. 2016-169483, filed Aug. 31, 2016, which are hereby incorporated by reference herein in their entirety.

What is claimed is:

1. An electrophotographic photosensitive member comprising:

a support;

an undercoat layer on the support; and a photosensitive layer on the undercoat layer, wherein the undercoat layer comprises:

(α) a metal oxide particle;

(β) a compound represented by formula (1):

TABLE 1

| | | (β) Compound represented by formula (1) | | | (γ) Compound represented by formula (2) | | | |
|---|---|---|---|---|---|---|---|---|
| | (α) Metal oxide particle | Structure | Amount used (parts) | Content (% by mass) to (α) in coating liquid for undercoat layer | Structure | Amount used (×1/100) (parts) | Content (% by mass) to (β) in coating liquid for undercoat layer | ΔVL (V) in 20000-page repetitive use |
| Example 1 | Zinc oxide | Formula (1-1) | 0.8 | 1.0 | Formula (2-1) | 1.6 | 2.0 | +8 |
| Example 2 | particle | | 0.04 | 0.05 | | 0.08 | 2.0 | +17 |
| Example 3 | 80 parts | | 0.16 | 0.2 | | 0.32 | 2.0 | +12 |
| Example 4 | | | 2.4 | 3.0 | | 4.8 | 2.0 | +10 |
| Example 5 | | | 4.0 | 5.0 | | 8.0 | 2.0 | +15 |
| Example 6 | | | 0.8 | 1.0 | | 0.64 | 0.8 | +14 |
| Example 7 | | | 0.8 | 1.0 | | 8.0 | 10 | +9 |
| Example 8 | | | 0.8 | 1.0 | | 16.0 | 20 | +15 |
| Example 9 | | | 0.04 | 0.05 | | 0.032 | 0.8 | +20 |
| Example 10 | | Formula (1-3) | 0.16 | 0.2 | | 0.64 | 4.0 | +18 |
| Example 11 | | | 1.6 | 2.0 | | 6.4 | 4.0 | +15 |
| Example 12 | | Formula (1-4) | 1.6 | 2.0 | | 6.4 | 4.0 | +20 |
| Example 13 | | Formula (1-1) | 0.8 | 1.0 | Formula (2-2) | 3.2 | 4.0 | +13 |
| Example 14 | | | 0.04 | 0.05 | | 0.032 | 0.8 | +19 |
| Example 15 | | Formula (1-12) | 0.8 | 1.0 | Formula (2-3) | 1.6 | 2.0 | +17 |
| Example 16 | | | 0.8 | 1.0 | | 8.0 | 10 | +19 |
| Example 17 | | | 0.04 | 0.05 | | 0.032 | 0.8 | +23 |
| Comparative Example 1 | Zinc oxide particle | Formula (1-1) | 0.8 | 1.0 | Not used | | — | +36 |
| Comparative Example 2 | 80 parts | Not used | | — | Formula (2-1) | 1.6 | — | +58 |
| Comparative Example 3 | | Formula (1-1) | 0.8 | 1.0 | Formula (G) | 1.6 | 2.0 | +33 |
| Comparative Example 4 | | Formula (H) | 0.8 | 1.0 | Formula (2-1) | 1.6 | — | +51 |

(1)

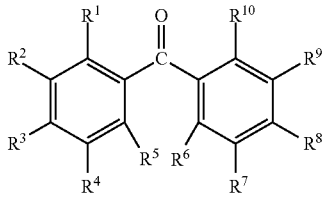

wherein $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group, and $R^6$ to $R^{10}$ each independently represent a hydrogen atom, a hydroxy group, a halogen atom, an alkyl group having 1 or more and 6 or less carbon atoms, an alkoxy group having 1 or more and 8 or less carbon atoms, or an amino group, provided that 1 or 2 of $R^6$ to $R^{10}$ are hydroxy groups and there is not a case where 3 or more of $R^6$ to $R^{10}$ are hydroxy groups; and (γ) a compound represented by formula (2):

(2)

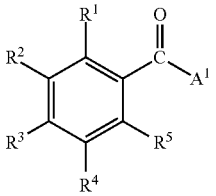

wherein $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group, and $A^1$ represents an alkenyl group having 2 or more and 4 or less carbon atoms.

2. The electrophotographic photosensitive member according to claim 1, wherein the (α) comprises a zinc oxide particle.

3. The electrophotographic photosensitive member according to claim 1, wherein the (β) comprises a compound represented by the formula (1) wherein 2 adjacent groups of $R^6$ to $R^{10}$ are hydroxy groups.

4. The electrophotographic photosensitive member according to claim 1, wherein the (γ) comprises a compound represented by the formula (2) wherein $A^1$ is a 1-propenyl group.

5. A process cartridge integrally supporting:

an electrophotographic photosensitive member; and at least one unit selected from the group consisting of a charging unit, a developing unit, a transferring unit and a cleaning unit, the process cartridge being detachably attachable to an electrophotographic apparatus main body, wherein the electrophotographic photosensitive member comprises:

a support;

an undercoat layer on the support; and a photosensitive layer on the undercoat layer, wherein the undercoat layer comprises:

(α) a metal oxide particle;

(β) a compound represented by formula (1):

(1)

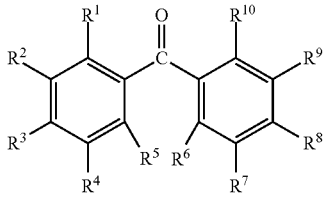

wherein $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group, and $R^6$ to $R^{10}$ each independently represent a hydrogen atom, a hydroxy group, a halogen atom, an alkyl group having 1 or more and 6 or less carbon atoms, an alkoxy group having 1 or more and 8 or less carbon atoms, or an amino group, provided that 1 or 2 of $R^6$ to $R^{10}$ are hydroxy groups and there is not a case where 3 or more of $R^6$ to $R^{10}$ are hydroxy groups; and (γ) a compound represented by formula (2):

(2)

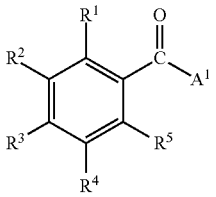

wherein $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group, and $A^1$ represents an alkenyl group having 2 or more and 4 or less carbon atoms.

6. An electrophotographic apparatus comprising:

an electrophotographic photosensitive member;

a charging unit;

an exposing unit;

a developing unit; and a transferring unit, wherein the electrophotographic photosensitive member comprises:

a support;

an undercoat layer on the support; and a photosensitive layer on the undercoat layer, wherein the undercoat layer comprises:

(α) a metal oxide particle;

(β) a compound represented by formula (1):

(1)

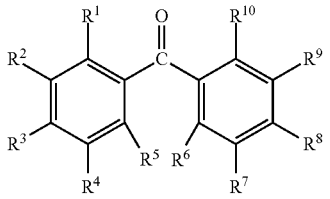

wherein $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group, and $R^6$ to $R^{10}$ each independently represent a hydrogen atom, a hydroxy group, a halogen atom, an alkyl group having 1 or more and 6 or less carbon atoms, an alkoxy group having 1 or more and 8 or less carbon atoms, or an amino group, provided that 1 or 2 of $R^6$ to $R^{10}$ are hydroxy groups and there is not a case where 3 or more of $R^6$ to $R^{10}$ are hydroxy groups; and (γ) a compound represented by formula (2):

(2)

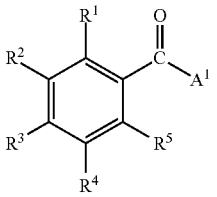

wherein $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group, and $A^1$ represents an alkenyl group having 2 or more and 4 or less carbon atoms.

7. A process for producing an electrophotographic photosensitive member, the process comprising:

forming an undercoat layer on a support; and forming a photosensitive layer on the undercoat layer, wherein forming the undercoat layer is coating the support with a coating liquid for an undercoat layer to form a coating film, the coating liquid comprising:

(α) a metal oxide particle;

(β) a compound represented by formula (1):

(1)

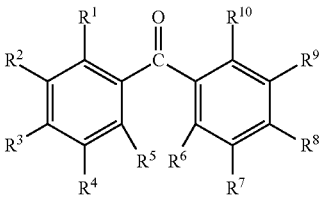

wherein $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group, and $R^6$ to $R^{10}$ each independently represent a hydrogen atom, a hydroxy group, a halogen atom, an alkyl group having 1 or more and 6 or less carbon atoms, an alkoxy group having 1 or more and 8 or less carbon atoms, or an amino group, provided that 1 or 2 of $R^6$ to $R^{10}$ are hydroxy groups and there is not a case where 3 or more of $R^6$ to $R^{10}$ are hydroxy groups; and (γ) a compound represented by formula (2):

(2)

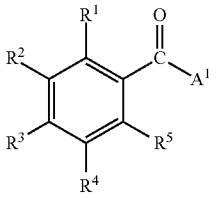

wherein $R^1$ to $R^5$ each independently represent a hydrogen atom, a halogen atom, an alkyl group having 1 or more and 6 or less carbon atoms, an alkoxy group having 1 or more and 8 or less carbon atoms, or an amino group, and $A^1$ represents an alkenyl group having 2 or more and 4 or less carbon atoms, and drying and/or curing the coating film, thereby forming the undercoat layer.

8. The process for producing an electrophotographic photosensitive member according to claim 7, wherein a content of the (β) in the coating liquid for an undercoat layer is 0.1% by mass or more and 4.0% by mass or less relative to a content of the (α) in the undercoat layer.

9. The process for producing an electrophotographic photosensitive member according to claim 7, wherein a content of the (γ) in the coating liquid for an undercoat layer is 1.0% by mass or more and 15% by mass or less relative to a content of the (β) in the undercoat layer.

* * * * *